US005732428A

United States Patent [19]

Brown

[11] Patent Number: 5,732,428

[45] Date of Patent: Mar. 31, 1998

[54] APPARATUS FOR SELECTIVE STRETCHING OF BOOTS AND SHOES USING INTERCHANGEABLE DRIVE MECHANISM

[76] Inventor: Dennis N. Brown, 6867 Holeman Ave., Blaine, Wash. 98230

[21] Appl. No.: 680,566

[22] Filed: Jul. 12, 1996

[51] Int. Cl.[6] ..... A43D 5/00

[52] U.S. Cl. ..... 12/115.4; 12/114.2; 12/114.4; 12/115.2

[58] Field of Search ..... 12/115.4, 114.2, 12/114.4, 114.6, 115.2

[56] References Cited

U.S. PATENT DOCUMENTS

| | | | |
|---|---|---|---|
| D. 360,816 | 8/1995 | Brown . | |
| 2,123,475 | 7/1938 | Sachs | 12/115.4 |
| 2,983,936 | 5/1961 | Wieblen | 12/115.4 |
| 4,060,869 | 12/1977 | Brown . | |
| 5,373,596 | 12/1994 | Harrell | 12/115.4 |
| 5,507,056 | 4/1996 | Brown . | |

FOREIGN PATENT DOCUMENTS

| | | |
|---|---|---|
| 127396 | 1/1902 | Germany . |
| 425011 | 2/1926 | Germany . |
| 5443 | 1/1902 | United Kingdom . |
| 139442 | 3/1920 | United Kingdom . |
| 319093 | 9/1929 | United Kingdom . |

*Primary Examiner*—Ted Kavanaugh
*Attorney, Agent, or Firm*—Todd N. Hathaway

[57] ABSTRACT

An apparatus for selectively stretching portions of boots and other footwear. There is a stretching assembly having first and second elongate arm members joined at a pivot point, so that forward jaw portions thereof are forced together in response to rearward extension sections being forced apart. A matched set of domed and cupped-shaped members stretches the material of the boot. The spring action is provided by interchangeable hydraulic cylinder and hand-operated screw-drive mechanisms.

17 Claims, 5 Drawing Sheets

APPARATUS FOR SELECTIVE STRETCHING OF BOOTS AND SHOES USING INTERCHANGEABLE DRIVE MECHANISM

BACKGROUND a. Field of the Invention

The present invention relates generally to apparatus for form-fitting shoes and boots, and, more particularly to an apparatus for selectively stretching portions of boots and shoes using hydraulic pressure or a hand-operated screw mechanism.

b. Background Art

The present invention, in one of its applications, is an accessory for use with Applicant's hydraulically-operated shoe and boot expander which is shown in U.S. Pat. No. 5,507,056, which is hereby incorporated by reference herein in its entirety. Inasmuch as U.S. Pat. No. 5,507,056 explains the need for custom form fitting of shoes and boots in detail, only a brief discussion of the matter will be included here.

The apparatus described in the above-referenced U.S. Pat. No. 5,507,056 has proven highly effective for use in the selected expansion (i.e., stretching) of ski boots. Modern ski boots, as well as many other types of footwear, are constructed of various grades of plastic material, as opposed to the more traditional leather. Applicant's previous invention consists of an expansion head having first and second, opposed hydraulic pistons which are forced outwardly by means of a hand-operated hydraulic pump. Interchangeable domed members are inserted into the outer ends of the pistons, and stretch the material of the boot outwardly where they bear against this. Although this device has been highly effective in its own right, one of the limitations has been that this generally uses a spreading action, so that there is an outward force against both sides of the boot; in other words, stretching of one side of the boot requires the application of outward force and possible stretching of the opposite side of the boot. In many cases, however, it is preferable to apply the force only in one, selected area, for example to relieve the pressure against a bunion or ankle bone.

Moreover, the sometimes exceptionally rigid material of which the shells of ski boots are commonly constructed often requires an increase in the amount of force which is applied to achieve the desired degree of stretching, sometimes above that which is beyond the optimum range of the prior device. Also, as the prior device generally applies pressure only against the inside surfaces of the boot, the amount of concentrated, localized deformation which can be achieved has been limited; in other words, the deformation has generally taken place over a somewhat extended area of the material, rather than being concentrated in a fairly confined location, such as adjacent the area of a bunion or small toe.

Accordingly, there exists a need for an apparatus which can apply strong pressure to deform the relatively stiff plastic material of ski boots. Moreover, there is a need for such an apparatus which can apply such stretching pressure on only one, selected side of the boot, and only within a relatively precise, confined area.

A further development has been the widespread popularity of in-line roller skate boots, commonly referred to as "rollerblades". Because of the lighter plastic materials of which these boots are commonly constructed, the amount of force which is required to achieve the desired amount of deformation of the shell is typically not as great as that which is required in the case of ski boots. Moreover, because of the somewhat different market factors involved, rollerblade boots are commonly sold and serviced by stores which may lack the facilities and capital investment of a full-service ski shop. Accordingly, there is a need for somewhat less powerful and more economical apparatus for the form fitting of rollerblade boots.

SUMMARY OF THE INVENTION

The present invention has solved the problems cited above, and is an apparatus for stretching selected portions of the shell of an article of footwear. Broadly, this comprises a stretching assembly having first and second elongate arm members, the arm members being interconnected at a pivot point so that first and section jaw sections thereof which extend forwardly of the pivot point are forced together in response to first and second extension sections thereof which extend rearwardly of the pivot point being forced apart, spreader means for selectively forcing the extension sections of the arm members apart so as to force the jaw sections together, and first and second cooperating tip members mountable to the jaw sections of the arm members, the first tip member having a domed pressure surface for engaging an inner surface of a footwear shell and the second tip member having a hollow cup area for engaging an outer surface of a footwear shell opposite the first tip member, so that as the first and second tip members are forced together, the footwear shell is stretched outwardly between the pressure surface and the cup area.

The stretching assembly may further comprise first and second pivotal mounting members for attachment of the spreader means between the extension sections, the mounting members being configured to prevent the spreader means to pivot relative to the arm members as the jaw sections open and close. The spreader means may comprise a hydraulic cylinder mountable between the extension sections of the first and second arm members, the hydraulic cylinder having first and second outwardly extending, closing piston members, the first piston member being attachable to the first mounting member and the second piston member being attachable to the second mounting member, and means for selectively supplying hydraulic pressure to the cylinder so as to force the opposing piston members outwardly therefrom, so as to selectively spread apart the extension sections of said arm members which are attached thereto.

The piston members of the hydraulic cylinder may be attached to the mounting members by means of first and second adapter units, each adapter units having a first end portion for engaging a socket formed in the piston member and a second end portion for engaging a cooperating opening in the mounting member.

The spreader means may further comprise a hand-operable screw-drive mechanism which is mountable to the extension sections interchangeably with the hydraulic cylinder. The screw-drive mechanism may comprise an elongate threaded shaft member and a handle member mounted to a first end thereof. The opening on the first mounting means may be a threaded bore for receiving the threaded shaft member therein and the opening in the second mounting means may comprise a socket for receiving a second end of the shaft member in non-threaded engagement therewith, so that in response of selected rotation of the screw-drive mechanism a length of the shaft member between the mounting members increases so as to force the extension sections apart.

The hollow cup area of the second tip member may have a perimeter wall which corresponds in shape to and is slightly larger than the pressure surface on the first tip member, so that the cup area is configured to receive the portion of the shell which is stretched outwardly by the domed pressure surface on the first tip member. The first and second tip members may be a part of a set comprising a plurality of matched tip members which are interchangeable mountable to the arm members.

DETAILED DESCRIPTION a. Overview

Figure 1:
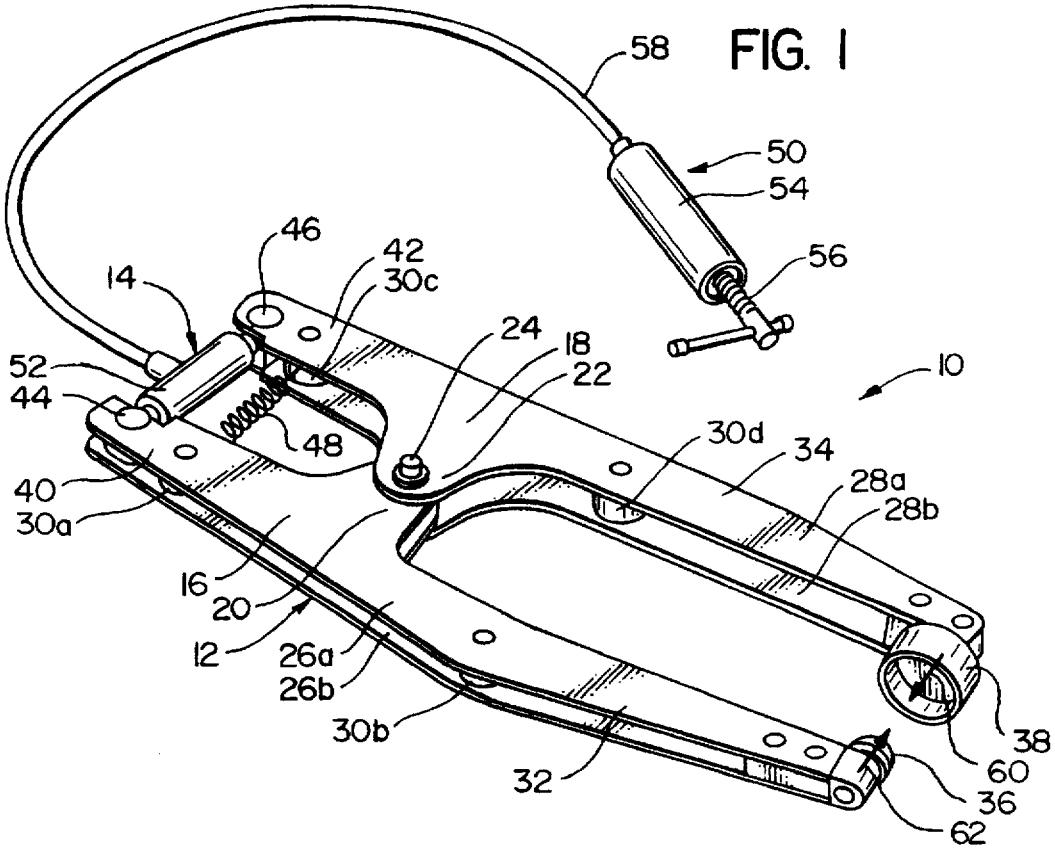
FIG. 1 is a perspective view of the stretching apparatus in accordance with the present invention, this being used in this view in conjunction with a hand-operated, hydraulically-powered expander device substantially as described in the above reference of U.S. Pat. No. 5,507,056.

FIG. 1 shows a boot stretching apparatus 10 in accordance with the present invention, this including a scissors-action stretching assembly 12 and a spreader mechanism 14 whereby power is supplied to the apparatus.

As can be seen, the scissors-action stretching assembly 12 includes first and second arm members 16, 18 which extend more or less parallel to one another, but which have inwardly extending portions 20, 22 which are joined at a vertical pivot pin 24. In the embodiment which is illustrated, the two arm members 16, 18 are each made of identical upper and lower metal plates **26*a*, 26*b* and 28*a*, 28*b* separated by spacers 30*a–d***, which affords a lightweight yet rigid construction, although it will be recognized that the arm members may be cast, machine or otherwise formed as a single piece, rather than using the built-up construction which is shown.

Forwardly of pivot 24, the two arm members extend to form the first and second opposing jaw sections 32, 34. A domed pressure member 36 and cup-shaped receptacle member 38 are mounted at the tips of the two jaw sections, in cooperating relationship: in other words, the receptacle member is sized and configured generally to receive the domed-shaped pressure member 36 therein, allowing for the thickness of the boot shell, as will be described in greater detail below.

Rearwardly from pivot 24, the two arm members form extension sections 40, 42. Proximate their outer ends, these are fitted with mountings 44, 46 which are pivotable about vertically extending axes, and which are configured to engage and receive the outwardly directed force of the spread mechanism 14. A spring 48 is connected between the two extension sections to maintain inward tension against the spreader mechanism.

In the embodiment which is illustrated in FIG. 1, the spreader mechanism is provided by a hydraulic spread mechanism 50 which is substantially similar to that which is described in the above-referenced U.S. Pat. No. 5,507,056. Accordingly, as will be described in greater detail below, there is a head unit 50 having diametrically opposed pistons which extend outwardly therefrom in response to hydraulic pressure being supplied from a hand-operated pressure unit 54. Rotation of the hand-driven screw mechanism 56 thereof operates the hydraulic piston within the pressure unit so as to supply hydraulic pressure to head unit 52, via flexible hose 58.

Accordingly, outward extension of the pistons in the hydraulic head unit 52 spreads the two extension section 40, 42 apart, consequently forcing the ends of the two jaw sections 32, 34 together, in the direction indicated by arrows 60, 62 in FIG. 1. The distance from the tips of the two jaw sections to the pivot 24 is greater than that from the pivot to the ends of the two extension sections, so that the mechanical advantage which is afforded thereby is enjoyed at the pressure area between the pressure and receptacle members 36, 38; this mechanical advantage enables the apparatus to deform even a comparatively stiff material of which ski boot shells are construction while maintaining the hydraulic pressure unit 54 within parameters which are acceptable for hand operation.

Figure 2:
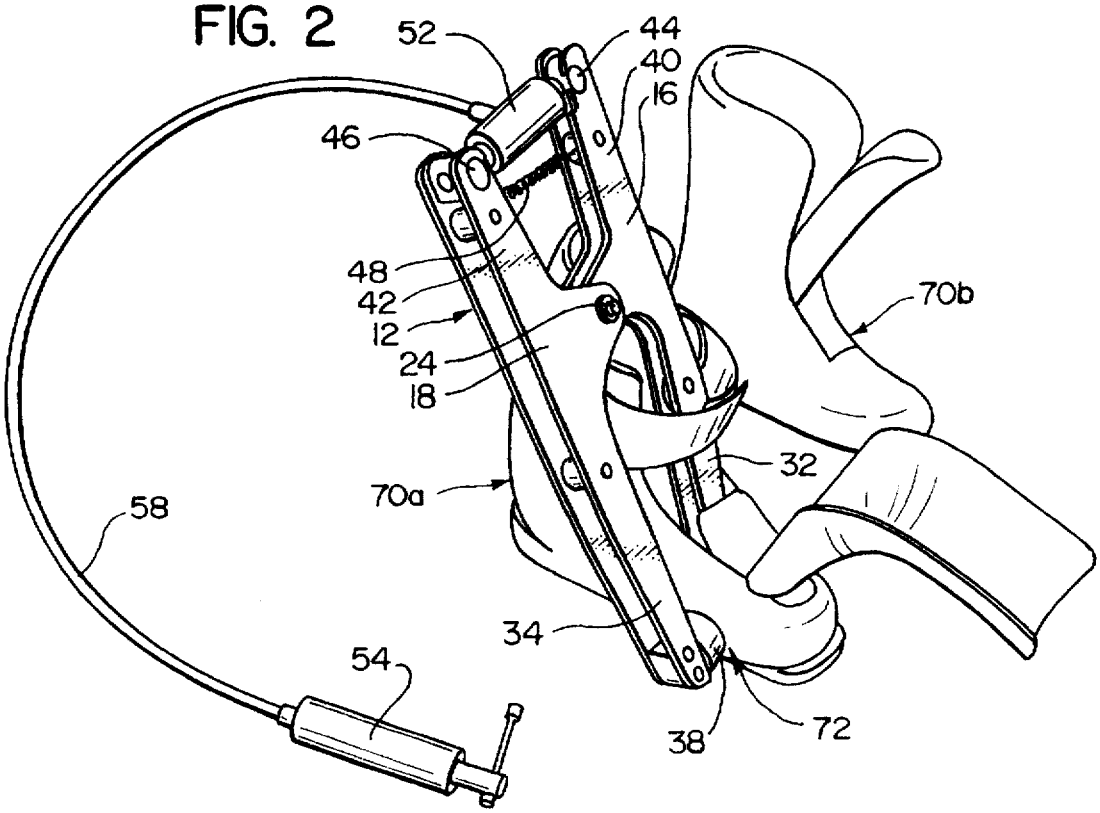
FIG. 2 is a perspective view showing the stretching apparatus of FIG. 1 being used to stretch a selected area of one side of a conventional ski boot having a comparatively rigid plastic shell.

FIG. 2 shows the spreader mechanism 14 inserted into the interior of boot **70*a* so as to outwardly stretch a selected, precisely confined area 72 of determinant shape. As can be seen in FIG. 2, the two arm sections 32, 34** are sized to have sufficient length to permit these to reach from the ankle opening clear to the toe end of the boot of the largest size normally encountered.

Figure 3:
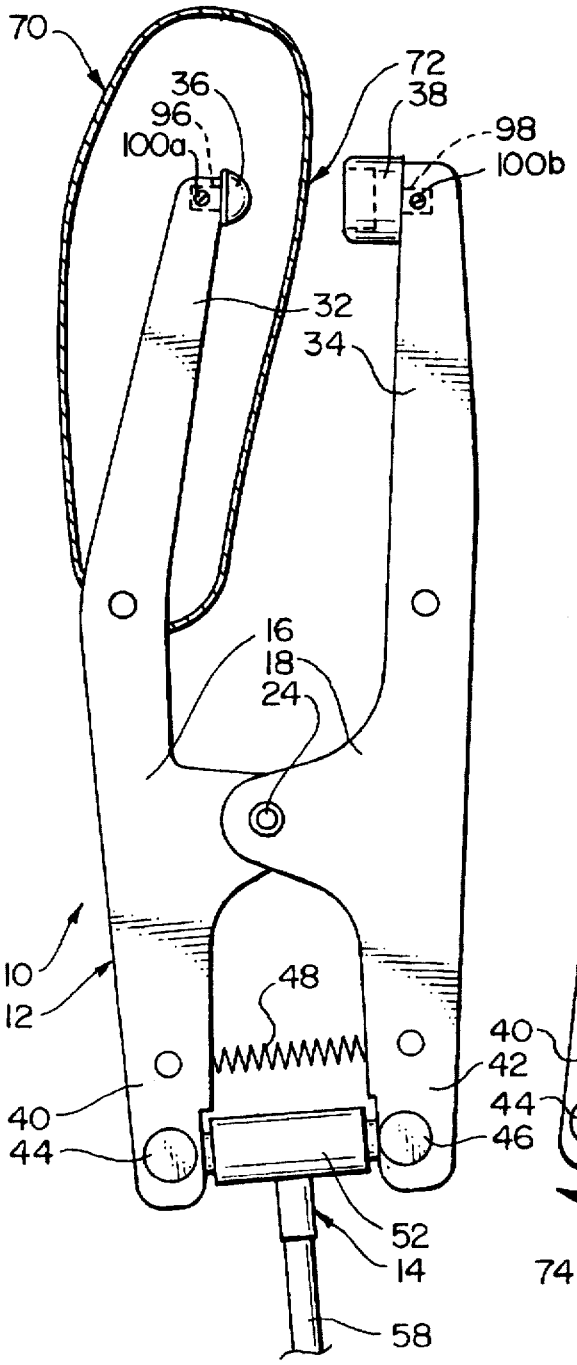
FIG. 3 is a plan view of the stretching apparatus of FIGS. 1–2, inserted into the interior of a ski boot which is shown in cross-section, showing the device in a first position in which the jaws are spread apart on the inside and outside of the ski boot shell.
Figure 4:
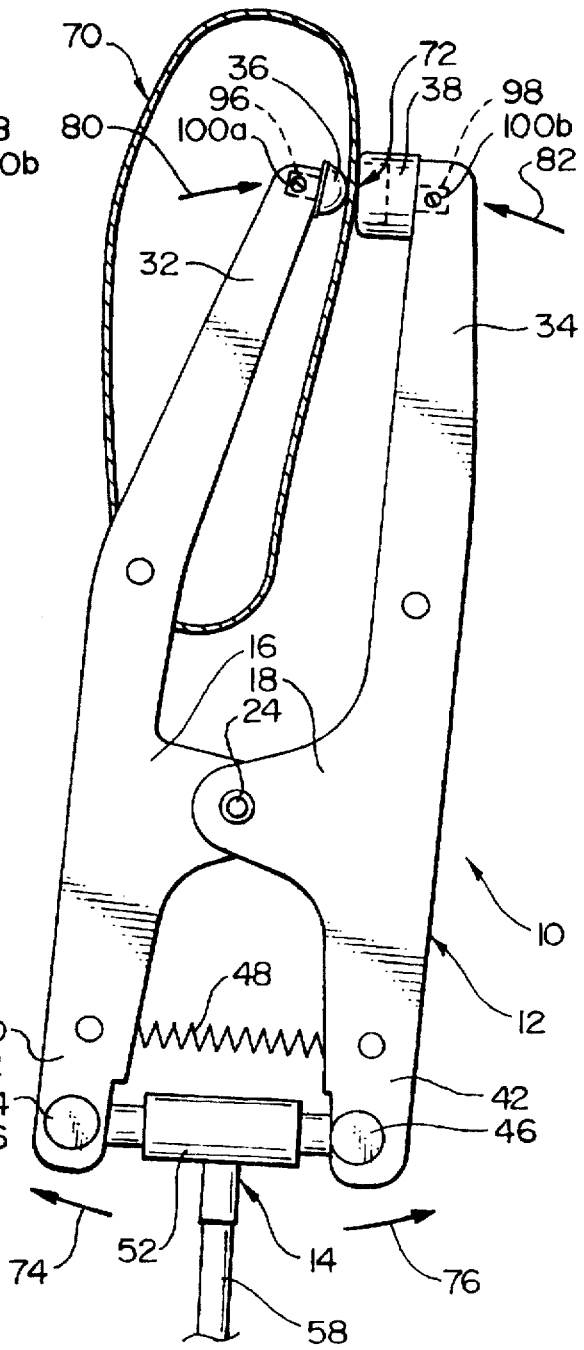
FIG. 4 is a plan view similar to that of FIG. 3, showing the hydraulic expander mechanism having been actuated so as to force the jaws of the stretching apparatus against the inside and outside of the ski boot shell, and deforming the selected area outwardly as desired.

FIGS. 3–4 provide a clearer illustration of the engagement of the jaw sections 32, 34 of the apparatus with the shell of the boot 70. As was noted above, the distance from the pivot 24 to the ends of the two jaw sections 32, 34 is sufficient to reach any point inside the boot. Similarly, the spacing between the two jaw section is sized to accommodate the side of the boot therein. Also, the inner of the two jaw sections 32 is angled inwardly (e.g., about 15°–20°) forward of the pivot point so as to more optimally position the domed pressure member 36 proximate the inner surface of the boot.

In use, as the operator manipulates the arms of the stretching assembly so as to position the domed pressure member 36 on the inside of the selected area 72 of the boot, with the cup-shaped receptacle member 38 positioned against the outside surface of the boot in this area. Actuation of the spreader mechanism 14, as by providing hydraulic pressure to the head unit 52, spreads the rearward extension sections 40, 42 apart, in the directions indicated by arrows 74, 76. This action forces the members at the tips of the two jaw sections 32, 34 together, in the direction indicated by arrows 80, 82, and in contact with the inner and outer surfaces of the boot shell in the selected area.

Figure 5A:
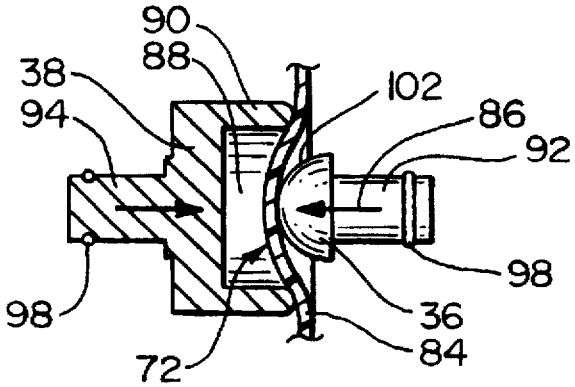
FIG. 5A is a plan view, partly in cross-section, showing the manner in which the domed member on the inner jaw and the corresponding cup-shaped receptacle on the outer jaw cooperate to selectively deform the material of the boot shell over a precisely confined area.
Figure 5B:
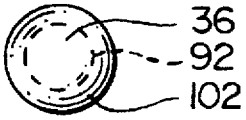
FIG. 5B is an end view of the domed member shown in FIG. 5A.
Figure 6A:
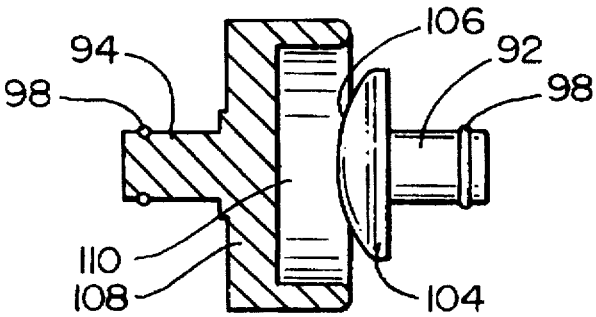
FIG. 6A and 6B are views corresponding to FIGS. 5A and 5B, showing domed and socket member which are interchangeable mountable in the jaws of the apparatus with those which are shown in FIGS. 5A and 5B.
Figure 6B:
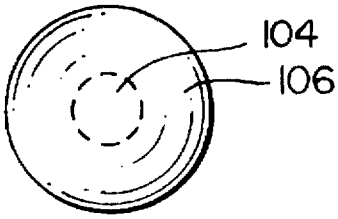

Continued application of force between the cooperating members deforms the plastic shell layer 84 of the boot outwardly, in the direction indicated by arrow 86 in FIG. 5A. The cavity 88 in the receptacle member 38 receives the outwardly stretching layer of material, while the perimeter wall 90 of the receptacle member supports the shell layer 84 in the area around the pressure member 36, so as confining the deformation to a precisely-controlled area. The extent of the deformation, in turn, can be controlled by selectively adjusting the amount of pressure which is supplied using the spreader mechanism 14. The result is an outwardly deformed bulge or "blister" of a precisely-controlled size and shape.

To remove the apparatus from the boot, the operator simply retracts the spreader mechanism, as by relieving the hydraulic pressure on head unit 52, so that the tension spring 48 draws the two extension sections together and spreads the jaw section's 32, 34 apart.

b. Interchangeable Tip Units

As was noted above, the pressure and receptacle members mounted at the tips of the jaw sections 32, 34 are a matched set, with the cup area in the receptacle member being generally configured to receive the pressure member therein, with allowance for the thickness of the cell material and the sharpness of the bend which is desired; a receptacle member configured to provide an annular gap of about ¼ inch around the pressure member has been found suitable for many applications, although this will vary according to the type of material and sharpness of the bend which is desired.

As is shown in FIG. 5A, the matched pressure end members are provided with stem portions 92, 94 which extend outwardly in opposite directions from the head portions thereof. The stem portions are detachably received in sockets 96, 98 in the ends of the jaw sections 32, 34, as shown in FIGS. 3–4 Each of the stem portions is preferably provided with an O-ring 98 for providing a firm, stable engagement between the stem portion and a socket, and set screws 100*a*, 100*b* extend into the sockets to engage the stem portions therein so as to maintain alignment between the pressure and receptacle members.

Figure 7A:
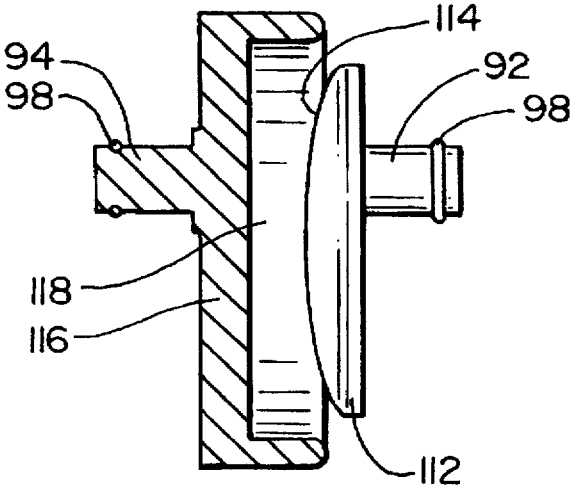
FIG. 7A and 7B show additional domed and cupped members which are interchangeable mountable in the jaws of the apparatus, these being ellipsoidal in configuration as opposed to circular.
Figure 7B:
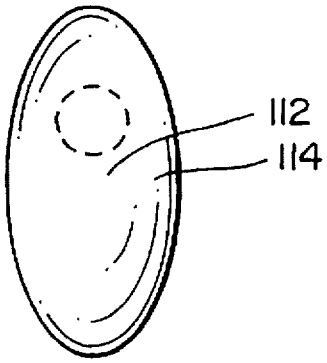

Accordingly, the pressure and receptacle members 36, 38 can be removed from the sockets in the ends of the jaw sections and interchangeably replaced with other pressure/receptacle members having different sizes or shapes, depending on the size or shape of the area of deformation which is desired for the particular user's foot. For example, as is shown in FIGS. 5A–5B and 6A–6B, the first pressure member 36 having circular, comparatively small diameter pressure head 102 and the corresponding receptacle member 38 can be replaced with a second pressure member 104 having a larger diameter pressure head 106, and the receptacle member 38 can likewise be replaced by a second receptacle member 108 having a cup area 110 with a correspondingly larger diameter. Also, as is shown in FIGS. 7A–7B, the shape of the two members can be varied as well as size, for example a pressure member 112 having an ellipsoidal pressure head 114 and a receptacle member 116 having a correspondingly ellipsoid cup area 118, as opposed to the circular members shown in FIGS. 5–6.

Accordingly, the present invention enables the operator to use an interchangeable set of pressure/receptacle members of various sizes and shapes with a single stretching and spreader assembly, thereby achieving significant cost and convenience advantages. The pressure/receptacle members may be formed of any suitable material, with cast or machined steel, aluminum, or brass being eminently suitable for this purpose.

c. Spread Mechanism

Figure 8A:
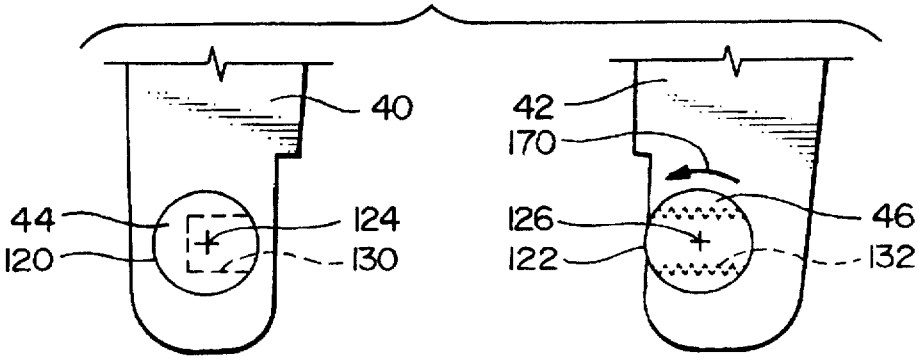
FIG. 8A is a plan view of the rearward extensions of the two law members of the stretching apparatus of FIGS. 1–4 showing the first and second pivotable mountings therein for the interchangeable expansion mechanisms.

FIG. 8A shows the ends of the two extension sections 40, 42 of the stretching assembly, and the pivotable mountings 44, 46 which are provided therein. As can be seen, each of the pivotable mountings comprises a cylindrical barrel member 120, 122, which is mounted in a corresponding bore in the end of the extension section for rotation about a vertical axis 124, 126. The pivotal mountings allow for the change in angular orientation which curves between the spreader mechanism and the two arm members of the stretching assembly during operation, and are preferably formed of a durable, wear resistant material such as steel.

The first vale member 120 is provided with an internal, horizontally-extending socket 130, while the second vale member 122 has a horizontally-extending threaded bore 132. As will be described in greater detail below, this combination of fittings enables the stretching assembly to be used with both hydraulic and hand-rotated spreader mechanisms.

Figure 8B:
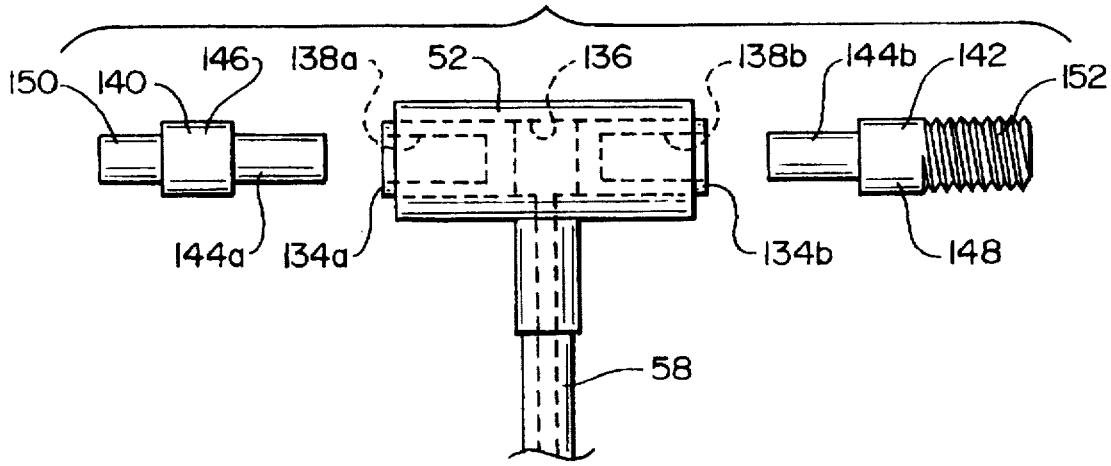
FIG. 8B is a plan view of a first expansion mechanism for use with the scissors-action stretching mechanism of FIGS. 1–4, this comprising the hydraulic expansion head and first and second adapter units for interconnecting the outwardly opposed pistons thereof with the pivotable mountings in the rearward ends of the scissors-action mechanism, as shown in FIG. 8A.

FIG. 8B provides an enlarged view of the hydraulic spreader mechanism having the head assembly 52 with diametrically opposed pistons 134*a*, 134*b* which are driven outwardly by hydraulic pressure which is supplied to a central chamber 136 by means of the hand-operated pressure unit and flexible hose 58. Each of the pistons 134*a*, 134*b* is provided with an outwardly extending socket 138*a*, 138*b*. As was noted above, these pressure units have previously been provided for the internal stretching of boots, using a pair of outwardly directed, domed pressure members, similar in shape to the pressure members 36, 104, etc. shown in FIGS. 5–7, the stem portions of which are received in the sockets 138*a*, 138*b*. For use with the stretching assembly in accordance with the present invention, a pair of adapter units 140, 142 are provided which have identical stem portions 144*a*, 144*b* which are configured to be received in the socket portions 138*a*, 138*b* of the two pistons; in some embodiments, the stem portions 144 my be provided with O-rings or other members in a manner similar to those shown in FIGS. 5–7 in order to ensure a tighter fit between the adapter units and the two pistons.

The adapter units have shoulder portions 146, 148 which bear against the outer end faces of the two pistons so as to receive the outwardly directed force thereof. The outer end of the first adapter unit 140 is provided with a cylindrical step portion 150 which fits within the cylindrical socket 130 in the first rotatable mountings 44. The end of the second adapter unit 142 is formed by a short length of threaded rod 152 which threads into the bore 142 formed in the second pivotal mount 46. Thus, in order to install the hydraulic spreader head 52 in the stretching assembly, the ends of the two adapter units are first inserted into the corresponding barrel members and the ends of the two extension sections are then spread apart by pressing the tips of the jaw sections together. The stems of the two adapter units are then inserted into the sockets in the hydraulic head unit, rotating the barrel members 120, 122 as necessary to achieve correct alignment. The jaw sections are then released, and the tension provided by spring 48 thereafter holds the hydraulic head in secure engagement with the two extension sections.

Figure 8C:
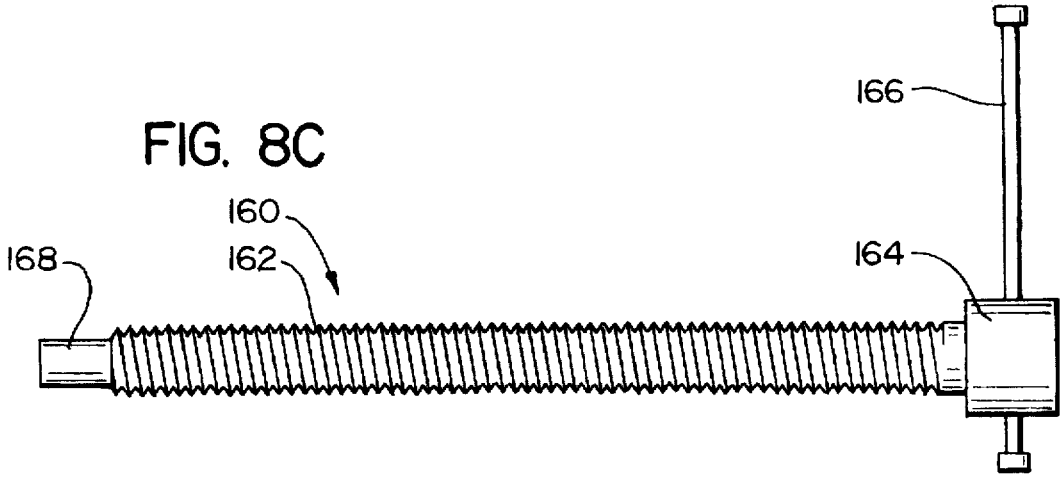
FIG. 8C is a plan view of a second expander mechanism, this being interchangeable with that shown in FIG. 8B, which employs a hand-rotated screw mechanism to spread the ends of the scissors extensions, in place of the hydraulic pistons.

FIG. 8C, in turn, shows the hand-rotated spreader mechanism 54, which can be used in place of the hydraulic mechanism described above. The hand-rotated mechanism comprises an elongate drive screw 162 which is configured to be threaded into bore 132 in the second barrel member 122. A head member 164 on one end of the drive screw is provided with a tommy bar 166 for manual rotation of the screw, the opposite end of which is provided with a short cylindrical stud member 168 which corresponds to the stud member 150 on the adapter unit 140 described above.

Accordingly, to install the hand-rotated spreader mechanism, the second barrel member 122 is rotated 180° from the position in which this is used with the adapter unit 142, as indicated by the arrow 170 in FIG. 8A; this arrangement permits the use of standard, right-handed threads on both the adapter unit 142 and the drive screw 162. The drive screw 162 is then threaded through bore 132, and rotation is continued until the stud member 168 is received in the socket 130 in the other barrel member 120. The cylindrical configuration of the stud member/socket permits free rotation of the drive screw member, and the tension spring 48 ensures firm engagement between extension section 40 and the end of the mechanism 160.

Figure 9:
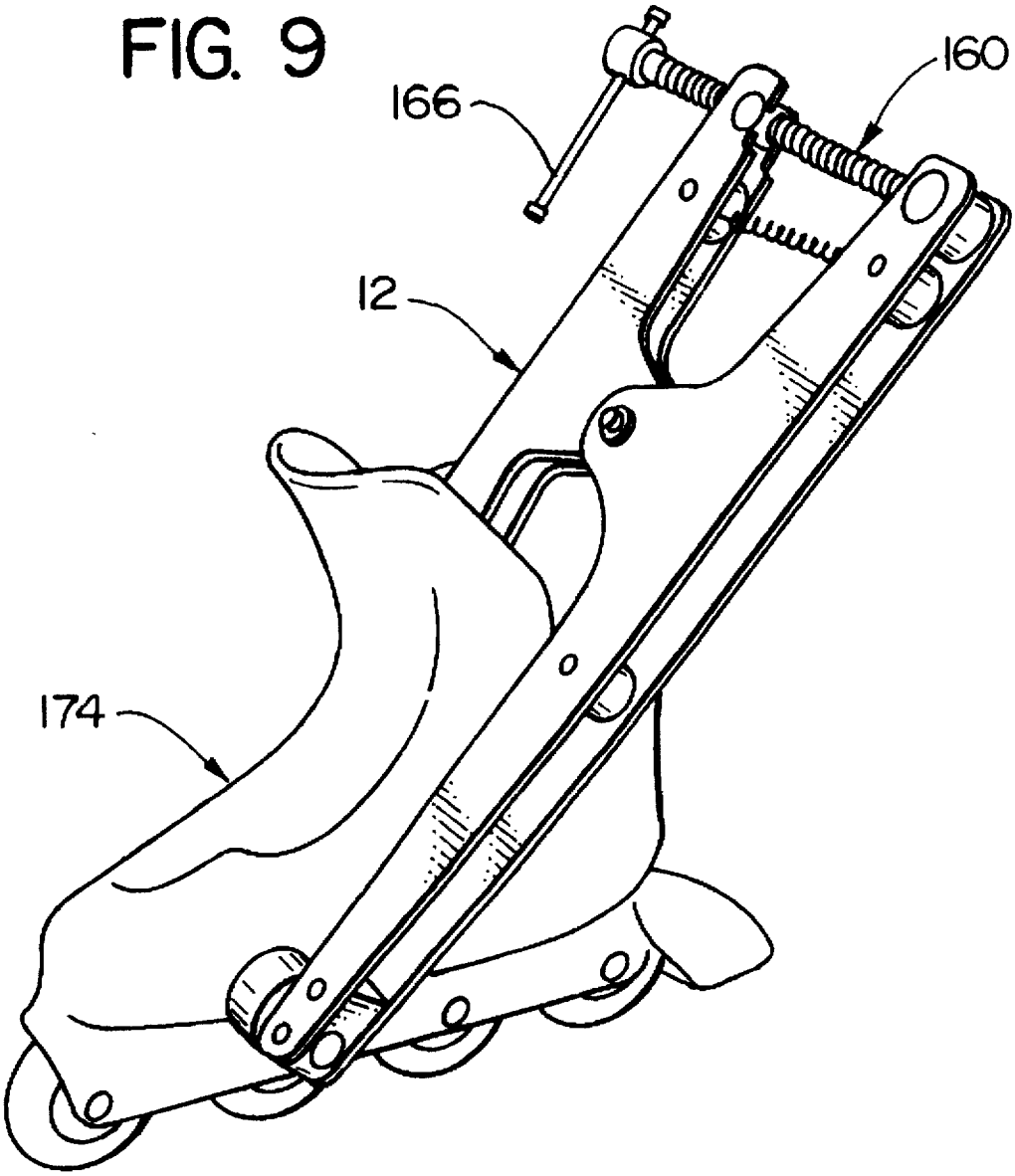
FIG. 9 shows the stretching apparatus using the hand-operated screw spreader mechanism of FIG. 8, being used to stretch a selected area of an in-line roller skate boot when the force which is generated by the screw mechanism is configured to deform the comparatively less rigid plastic material which is used in the construction thereof.

Thus, by rotating the drive screw in a clockwise direction using the tommy bar 166 or other handle fitting, the length of the drive screw between the ends of the two extension sections increases and spreads them apart, forcing the jaws of the spreader assembly into engagement with the shell of the boot in the manner shown in FIGS. 3–4; reverse rotation of the drive screw spreads the tips of the jaw portions apart. As was noted above, the hand-rotated spreader mechanism 160 is typically less able than the hydraulic mechanism to generate high pressures between the pressure and receptacle members at the tips of the jaw section while still remaining within a comfortable level of exertion on the part of the operator. However, as is also noted above, the lesser pressures which may be comfortably generated using the hand-rotated mechanism are eminently suited to use with the lighter materials of which other boots, in particular in-line skate boots, are commonly constructed. Accordingly, FIG. 9 illustrates a skate boot 174 being stretched in a selected area using the stretching assembly 12 fitted with the hand-rotated spreader mechanism 160. It will be noted that the angle at which the assembly stands upwardly and outwardly from the ankle opening of the boot serves to position the handle 166 at a convenient height and location for a hand operation. Also, as was noted above, the leverage which is afforded by the greater makes it easy for the operator to accomplish the desired degree of stretching of the good material with a comfortable amount of exertion.

Other spreader mechanisms suitable for use with the stretching assembly may occur to those skilled in the art, accordingly it is to be recognized that various alterations, modifications, and/or additions may be introduced into the constructions and arrangements of parts described above without departing from the spirit or ambit of the present invention as defined by the appended claims.

What is claimed is:

1. Apparatus for stretching a selected portion of a footwear shell, said apparatus comprising:

a stretching assembly having first and second elongate arm members, said arm members being interconnected at a pivot point so that first and second jaw sections thereof which extend forwardly of said pivot point are forced together in response to first and second extension sections thereof which extend rearwardly of said pivot point being forced apart;

spreader means for selectively forcing said extension section of said arm members apart so as to force said jaw sections together, said spreader means comprising:

a hydraulic cylinder mountable between said extension section of said first and second arm members, said hydraulic cylinder having first and second outwardly extending, opposing piston members, said first piston member being attachable to said first mounting member and said second piston member being attachable to said second mounting member; and means for selectively supplying hydraulic pressure to said cylinder so a to force said opposing piston members outwardly therefrom, so as to selectively spread apart said extension sections of said arm members which are attached thereto;

first and second pivotable mounting members for attachment of said spreader means between said extension sections of said first and second arms, said mounting members being configured to permit said spreader means to pivot relative to said arm member as said jaw sections open and close; and first and second cooperating tip members mountable to said jaw sections of said arm members, said first tip member having a domed pressure surface for engaging an inner surface of a footwear shell and said second tip member having a hollow cup area for engaging an outer surface of a footwear shell opposite said first tip member, so that as said first and second tip member on said jaw sections are forced together said footwear shell is stretched outwardly between said pressure surface and said cup area.

2. The apparatus of claim 1, wherein each said piston member in said hydraulic cylinder has a socket formed in an outer end thereof, and wherein said spreader means further comprises:

first and second adaptor units for attaching said piston members to said mounting members, each said adaptor unit having a first end portion for engaging said sockets in said piston members and a second end portion for engaging cooperating openings in said mounting members.

3. The apparatus of claim 2, wherein said spreader means further comprises:

a hand-operable screw-drive mechanism which is mountable to said extension sections of said stretching assembly.

4. The apparatus of claim 3, wherein said hand-operable screw-drive mechanism comprises:

an elongate threaded shaft member; and a handle member mounted to a first end of said threaded shaft member for manual rotation thereof.

5. The apparatus of claim 4, wherein said opening in said first mounting means comprises a threaded bore for receiving said threaded shaft member therein, and said opening in said second mounting means comprises a socket for receiving a second end of said shaft member in non-threaded engagement therewith, so that in response to selective rotation of said screw-driver mechanism a length of said shaft member between said mounting members increases so as to force said extension sections apart.

6. The apparatus of claim 5, wherein said second end of said first adaptor member comprises a threaded rod section for engaging said threaded bore in said first mounting member.

7. The apparatus of claim 6, wherein each of said pivotable mounting member comprises a barrel member which is rotatable about an axis which extends generally parallel to an axis of said pivot point.

8. The apparatus of claim 1, wherein said hollow cup area of said second tip member has a perimeter wall which corresponds in shape to and is slightly larger said pressure surface on said first tip member, so that said cap area is configured to receive said portion of said shell which is stretched outwardly by said domed pressure surface on said first tip member.

9. The apparatus of claim 8, wherein said first and second tip members are part of a set comprising a plurality of matched tip members which are selectively mountable to said arm members.

10. The apparatus of claim 9, wherein said jaw sections of said arm members are sized to have sufficient length to reach fully into the toe area of an article of footwear.

11. The apparatus of claim 1, wherein said hollow cup area of said second tip member has a perimeter wall which corresponds in shape to and is slightly larger said pressure surface on said first tip member, so that said cup area is configured to receive said portion of said shell which is stretched outwardly by said domed pressure surface on said first tip member.

12. The apparatus of claim 11, wherein said first and second tip members are part of a set comprising a plurality of matched tip members which are selectively mountable to said arm members.

13. The apparatus of claim 12, wherein said jaw sections of said arm members are sized to have sufficient length to reach fully into the toe area of an article of footwear.

14. Apparatus for stretching a selected portion of a footwear shell, said apparatus comprising:

a stretching assembly having first and second elongate arm members, said arm members being interconnected at a pivot point so that first and second jaw sections thereof which extend forwardly of said pivot point are forced together in response to first and second extension sections thereof which extend rearwardly of said pivot point being forced apart;

spreader means for selectively forcing said extension section of said arm members apart so as to force said jaw sections together;

first and second pivotable mounting members for attachment of said spreader means between said extension sections of said first and second arms, said mounting members being configured to permit said spreader means to pivot relative to said arm member as said jaw sections open and close, said mounting members further including means for interchangeable attachment of (a) a first said spreader means which comprises:

a hydraulic cylinder mountable between said extension section of said first and second arm members, said hydraulic cylinder having first and second outwardly extending, opposing piston members; and means for selectively supplying hydraulic pressure to said cylinder so as to force said opposing piston members outwardly therefrom; and (b) a second said spreader means which comprises:

an elongate threaded shaft member; and a handle member mounted to a first end of said threaded shaft member for manual rotation thereof, so that in response to selective rotation of said shaft member a portion of said shaft member between said mounting members increases in length so as to force said extension sections apart; and first and second cooperating tip members mountable to said jaw sections of said arm members, said first tip member having a domed pressure surface for engaging an inner surface of a footwear shell and said second tip member having a hollow cup area for engaging an outer surface of a footwear shell opposite said first tip member, so that as said first and second tip members on said jaw sections are forced together said footwear shell is stretched outwardly between said pressure surface and said cup area.

15. The apparatus of claim 14, wherein said means for interchangeable attachment of said first and second spreader means comprises:

a portion of said first mounting means having an opening with a threaded bore for receiving said threaded shaft member of said second spreader means therein;

a portion of said second mounting means having an opening with a socket for receiving a second end of said shaft member in non-threaded engagement therewith; and first and second adaptor units for attaching said piston members to said pivotable mounting members, each said adaptor unit having a first end portion of engaging a socket formed in an outer end of said piston members and a second end portion for engaging said openings in said mounting members, said second end of said first adaptor member having a threaded rod section for engaging said threaded bore in said first mounting member and said second end of said second adaptor member having a rod section for engaging said socket in said second mounting member.

16. The apparatus of claim 15, wherein each of said pivotable mounting members comprises a barrel member which is rotatable about an axis which extends generally parallel to an axis of said pivot point.

17. Apparatus for stretching a selected portion of a footwear shell, said apparatus comprising:

a stretching assembly having first and second elongate arm members, said arm members being interconnected at a pivot point so that first and second jaw sections thereof which extend forwardly of said pivot point are forced together in response to first and second extension sections thereof which extend rearwardly of said pivot point being forced apart;

first and second pivotable mounting members for attachment of a spreader means between said extension section of said first and second arms, said mounting members being configured to pivot relative to said arm member as said jaw sections open and close;

each of said pivotable mounting members comprising a barrel member which is rotatable about an axis which extends generally parallel to an axis of said pivot point, said first pivotable barrel member having an opening with a threaded bore for receiving a threaded shaft member and said second pivotable barrel member having an opening with a socket for receiving an end of said shaft member in a non-threaded engagement therewith;

said mounting members being configured for interchangeable attachment of (a) a first spreader means which comprises:

a hydraulic cylinder mountable between said extension section of said first and second arm members, said hydraulic cylinder having, first and second outwardly extending, opposing piston members;

means for selectively supplying hydraulic pressure to said cylinder so as to force .said opposing piston members outwardly therefrom; and first and second adaptor units for attaching said piston members to said pivotable barrel members, each said adaptor unit having a first end portion for engaging a socket formed in an outer end of each said piston member and a second end portion for engaging a selected one of said openings formed in said barrel members; and (b) a second spreader means which comprises:

an elongate threaded shaft member for being received in said opening in said first barrel member in threaded engagement therewith, so that said shaft member extends through said first barrel member and a first end of said shaft member is received in said opening in said second barrel member in non-threaded engagement therewith; and a handle member mounted to a first end of said threaded shaft member for manual rotation thereof, so that in response to selective rotation of said shaft member a portion of said shaft member between said barrel members increases in length; and first and second cooperating tip members mountable to said jaw section of said arm members, said first tip member having a domed pressure surface for engaging an inner surface of a footwear shell and said second tip member having a hollow cup area for engaging an outer surface of a footwear shell opposite said first tip member, so that as said first and second tip member on said jaw sections are forced together said footwear shell is stretched outwardly between said pressure surface and said cup area.

* * * * *